US007305202B2

(12) United States Patent
Daniels

(10) Patent No.: US 7,305,202 B2
(45) Date of Patent: Dec. 4, 2007

(54) METHOD AND APPARATUS FOR CONVERTING PROCESS CARTRIDGES TO FIT VARIOUS TYPES OF PRINTING MACHINES

(75) Inventor: Matthew P. Daniels, Pittsboro, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 11/503,601

(22) Filed: Aug. 14, 2006

(65) Prior Publication Data

US 2006/0275051 A1 Dec. 7, 2006

Related U.S. Application Data

(63) Continuation of application No. 11/213,203, filed on Aug. 26, 2005, now Pat. No. 7,103,299, which is a continuation of application No. 11/095,444, filed on Mar. 31, 2005, now Pat. No. 6,993,266, which is a continuation of application No. 10/319,088, filed on Dec. 14, 2002, now Pat. No. 6,904,248.

(51) Int. Cl.
*G03G 15/00* (2006.01)

(52) U.S. Cl. ..... 399/109

(58) Field of Classification Search ..... 399/109, 399/111, 113, 120, 123, 262, 360; 264/36.1
See application file for complete search history.

(56) References Cited

U.S. PATENT DOCUMENTS

| | | | | |
|---|---|---|---|---|
| 5,261,326 | A * | 11/1993 | Michlin | 101/483 |
| 5,729,795 | A * | 3/1998 | Kavolius et al. | 399/109 |
| 6,219,506 | B1 * | 4/2001 | Morinaga et al. | 399/109 |
| 6,654,577 | B1 * | 11/2003 | Hooper | 399/109 |
| 6,801,734 | B1 * | 10/2004 | Jones et al. | 399/109 |
| 6,904,248 | B2 * | 6/2005 | Daniels | 399/109 |
| 6,993,266 | B2 * | 1/2006 | Daniels | 399/109 |
| 7,103,299 | B2 * | 9/2006 | Daniels | 399/109 |
| 2004/0170445 | A1 * | 9/2004 | Moore et al. | 399/109 |
| 2005/0036801 | A1 * | 2/2005 | Burchette | 399/109 |
| 2005/0135836 | A1 * | 6/2005 | Rogers et al. | 399/109 |

* cited by examiner

*Primary Examiner*—Robert Beatty

(57) ABSTRACT

A method for modifying a process cartridge includes providing the process cartridge comprising a waste bin having physical characteristics. The method further includes altering the physical characteristics of the waste bin to form an altered process cartridge.

2 Claims, 9 Drawing Sheets

METHOD AND APPARATUS FOR CONVERTING PROCESS CARTRIDGES TO FIT VARIOUS TYPES OF PRINTING MACHINES

The present invention is a continuation of application Ser. No. 11/213,203 filed on Aug. 26, 2005, now U.S. Pat. No. 7,103,299 which in turn is a continuation of Ser. No. 11/095,444 filed on Mar. 31, 2005, now U.S. Pat. No. 6,993,266 which is in turn is a continuation of U.S. Pat. Ser. No. 10/319,088 filed on Dec. 14, 2002, now U.S. Pat. No. 6,904,248, all of which are incorporated by reference herein in their entirety.

FIELD OF THE INVENTION

The present invention relates to a method of modifying one type of xerographic process cartridge, such as a xerographic toner cartridge, for example, into another by removing a section of a process cartridge's waste bin assembly, affixing a plug into this area and resealing it. Additionally, further physical alterations of the original process cartridge such as trimming off guides, creating a circuit board mounting area and mounting a small circuit board in this location may be required for various other types of applications.

BACKGROUND OF THE INVENTION

In the printing industry, there has been a growing market for the remanufacture and refurbishing of various types of printing components and process cartridges such as toner cartridges, ink cartridges, magnetic rollers, seals etc. Process cartridges, such as toner cartridges, for example, once spent are unusable for their originally intended purpose. Without a refurbishing process, they would simply be discarded, even though the cartridge itself may still have potential life. As a result, there have been processes and procedures developed specifically to address this type of issue. These processes may entail the disassembly of the various structures of the cartridge, replacing toner, cleaning, adjusting or replacing any worn components and reassembling the cartridge.

The differences between printer cartridges for various types of printing devices may only be slight or subtle. In many instances it may only be an indentation in the body of the cartridge. In other cases it may be not only a physical attribute of the body of the cartridge, but also the addition of a wireless communications device. Certain style cartridges may be plentiful and relatively inexpensive simply because of certain factors such as the supply in the market or initial cost while other style cartridges may not be available in quantity or too expensive for cost effective use in remanufacturing. The easiest and most economic solution would be to simply convert the inexpensive style cartridges into the more costly style cartridge in order to meet this market demand. The present invention is directed at that conversion process. Additionally, the present invention may have a positive impact on the environment by cutting down on the amount of cartridges being thrown away by providing a new recycling alternative.

One conversion example is converting the Lexmark™ Optra S/Se/T style cartridge into a Lexmark™ T520/522. The Optra style cartridge has a smooth surface on its waste bin portion. The T520/522 style cartridge has an indented section on both the horizontal and vertical surfaces of the waste bin. This indentation allows the cartridge to physically fit into the printer, which has a protrusion to prevent the S/Se/T style cartridge from fitting. In addition, the T520/522 has a contact activated type of circuitry located on its side. In order to convert the Optra to a T520/T522 style cartridge, the waste bin has a section removed, a plug inserted, and the proper circuitry installed. The plug's shape is such that the new contour of the waste bin is similar enough to that of the T520/T522. The plug is either glued in or welded into place. The cartridge then undergoes the remaining refurbishing steps such as refilling of the toner hopper and resealing the cartridge.

Another example is converting a process cartridge, such as an HP4000™ toner cartridge, for example, to an HP4100™ toner cartridge. The 4100 cartridge is essentially the same as the HP4000 except for two minor characteristics. The first difference is the waste bin assembly on the HP4000 has a smooth contour while the HP4100 has an elongated grove. In addition, there are two guides that are present on the 4000 cartridge that are absent on the 4100 cartridge. The conversion process here entails the removal of the guides, the removal of a section of the waste bin and the installation of a plug that now once affixed into place gives the waste bin a new contour such that it will fit into the 4100 printer.

A further example of process cartridge conversion is the modification of the HP4000™ cartridge into one compatible with the Cannon FX6™ fax machine. This conversion only involves the removal of a section of the waste bin assembly of the toner cartridge and the attaching of a plug into that space removed.

SUMMARY OF INVENTION

The present invention describes a conversion process designed to allow one type of process cartridge, such as a toner cartridge, for example, to be converted to another by altering its physical characteristics.

In accordance with the preferred embodiment of the present invention, a method of making or refurbishing a printer cartridge may include modifying the physical attributes of the cartridge such that it will be able to be used once refurbished and modified in additional types of printing devices. The cartridge itself may be mounted into a conversion fixture that secures the waste bin assembly of the toner cartridge into place. The conversion fixture will have an opening corresponding to the area that will be removed from the waste bin assembly.

Various types of tools may be used to remove the portion of the waste bin assembly. A particularly effective tool for use in removing the area in question is the Rotozip® tool, a type of router. Another way the waste bin assembly may be modified is by using heat. For example this might encompass using a laser as the cutting device or just an intense heat to melt the outline instead of cutting.

The size and orientation of the portion being removed will vary according to the original type of cartridge as well as the intended future use of the cartridge. Once the portion is removed, a plug is then inserted into the section of the cartridge that is now an open area or recess. Depending on the type of cartridge and future application, the plug may vary in size and shape. The plug should be affixed into the recess of the waste bin assembly. This can be accomplished either by ultrasonic welding or some type of glue.

The preferred embodiment of the present invention will include a conversion fixture that will be unique depending upon the type of cartridge to be modified as well as the type of cartridge being reproduced. The waste bin assembly of the toner cartridge will need to be removed and cleaned prior to the conversion process. Once the waste bin assembly has been prepared, it is attached to the conversion fixture. This conversion fixture may contain guides to allow the waste bin to easily slide into place. The conversion fixture may also have a secondary securing assembly that will be attached to the waste bin assembly. The combined fixture will then contain a guide window that outlines the area of the waste bin assembly that is going to be removed. The guide window will have allowances set according to the type of tool being used. In addition, the conversion fixture may also have a trimming area such that the edges of some types of cartridges may be trimmed down.

In the preferred embodiment, the plug assembly will also vary depending on the type of cartridge as well as the intended application of the modified cartridge. These shapes may be triangular, rectangular or square in nature. The present invention is not intended to limit the size or shape of this plug; rather it is intended to illustrate the concept of the modification. The plug may not necessarily have an upper horizontal area, an upper vertical area or a lower horizontal area if it were to conform only to the edge of the recess. In the preferred embodiment, edges are included in the plug to provide a surface area for applying some type of adhesive to bond the plug to the waste bin assembly. In addition, the plug could conceptually be attached to the inside of the waste bin assembly. This might be more difficult given that there may be internal structures within the waste bin assembly that might prevent a good seal.

DETAILED DESCRIPTION OF THE INVENTION

The present invention is a method of making or refurbishing a printer cartridge by modifying the physical attributes of the cartridge such that it will be able to be used once refurbished and modified in additional types of printing devices. Specifically, altering the waste bin assembly of a cartridge by introducing an indentation in the surface of the waste bin assembly will allow the modified cartridge to fit into a different printing device. In the preferred embodiment, this indentation is located roughly in the center of the waste bin assembly.

Figure 1:
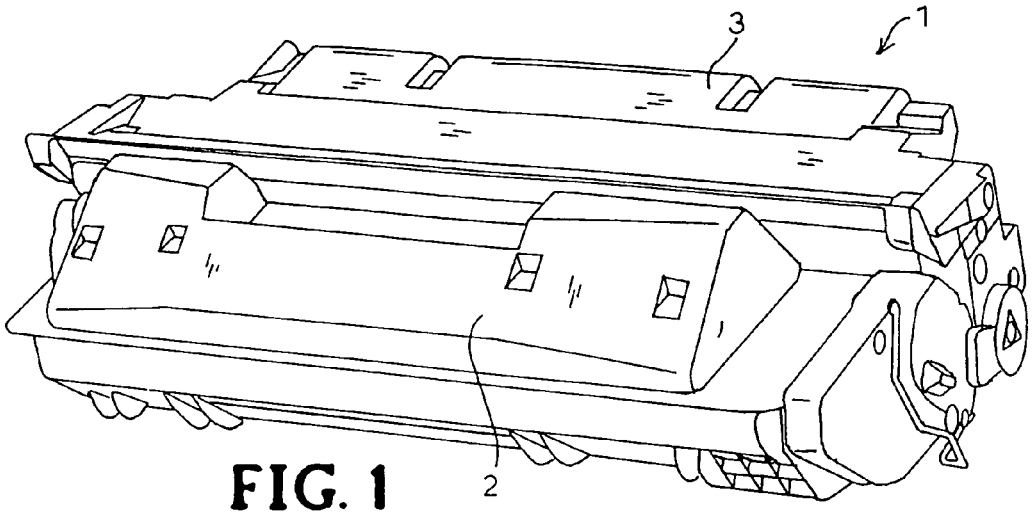
FIG. 1 (prior art) is a perspective view of an HP4000 toner cartridge.

FIG. 1 shows an exemplary prior art process cartridge, specifically an HP4000™ toner cartridge 1 and its basic exterior components. The waste bin assembly 2 is attached to the toner hopper 3. Within the process cartridge, or toner cartridge, there are additional pieces such as the magnetic roller, the drum, toner agitator, and so forth. In the preferred embodiment, after disassembly, the waste bin assembly's physical characteristics will be altered. After the present invention has been performed on the waste bin assembly, the toner cartridge will continue its process of being refurbished.

The method of converting a process cartridge, such as a toner cartridge, for example, from one type to another requires that the waste bin assembly 2 must be removed from the toner hopper assembly 3. The waste toner that has accumulated in the waste bin assembly should be discarded. The waste bin assembly should then be cleaned. A method of cleaning in the preferred embodiment is by using filtered compressed air to dislodge any of the remaining toner material. Another method is to use a clean lint free cloth to wipe over the area, or to use a cleaning solution.

Figure 2:
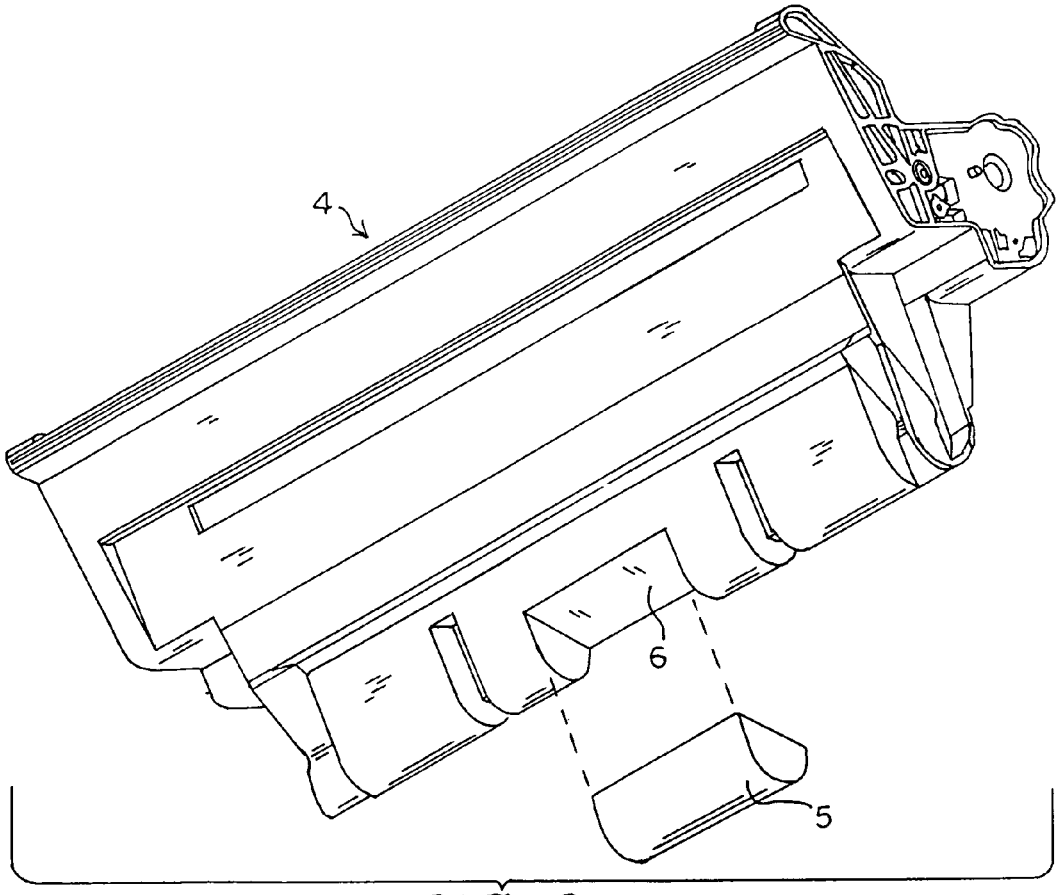
FIG. 2 is an illustrative view of an HP4000 toner waste bin assembly with portion removed.

FIG. 2 is an illustrative example of an HP4000™ waste bin assembly 4 that has a portion 5 of the waste bin assembly removed. In the preferred embodiment, the portion being removed should be located approximately in the center of the waste bin assembly. This portion will vary in size as well as shape depending on the conversion being performed. Once the portion is removed, the area that the portion once occupied is now a recess 6.

Various methods of removing the portion of the waste bin assembly may be used. These methods may employ different types of tools. A particularly effective method of removing the portion is to use a Rotozip® tool. The Rotozip is a type of router. Another way the waste bin assembly may be modified is by using heat. For example this might encompass using a laser as the cutting device or just an intense heat to melt the outline instead of cutting. Another possible way of modifying the waste bin assembly might be to use some type of sharp edged tool such as a razor blade, wire cutters or even scissors. Another method could be to use a jigsaw or other type of saw to remove the portion of the waste bin assembly. Additionally, one might use some type of grinder or uneven surfaced tool to wear down the portion of the waste bin assembly thus creating the recess.

The present invention is accomplished when the indentation in the waste bin assembly, once the plug is inserted, is such that the cartridge as modified will fit into a different printing device than originally intended. The plugs will vary in size and shape depending on the conversion being performed. In the preferred embodiment, the plug will have edges such that these edges will provide a surface area for applying an adhesive to bond the plug to the waste bin assembly. The method of attaching the plug into the waste bin may also vary. The plug might only be held in place by pressure rather than with some type of adhesive. The plug may be affixed into place by various methods of attachment such as adhesive glue, tape, caulk, or ultrasonic welding for example.

Figure 3A:
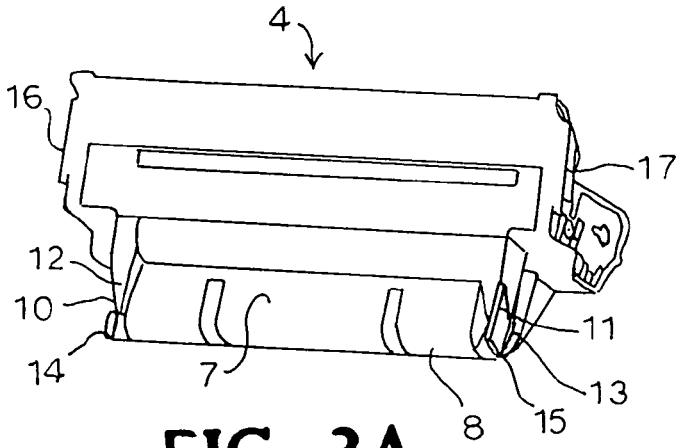
FIG. 3A shows a perspective view of the waste bin assembly of the 4000.
Figure 3B:
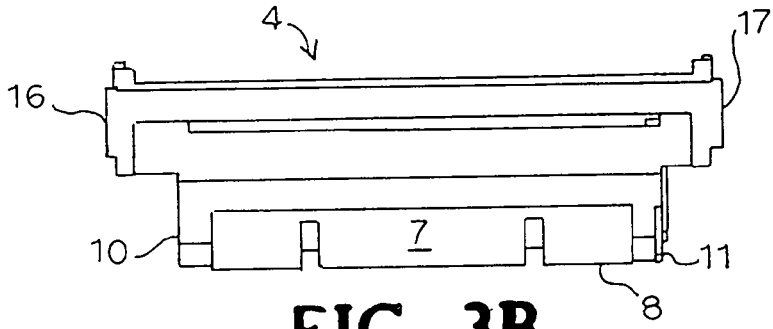
FIG. 3B shows a top view of the waste bin assembly of the 4000.
Figure 3C:
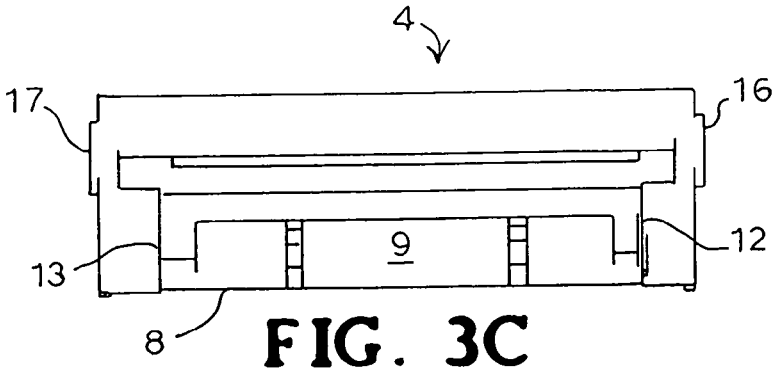
FIG. 3C shows a bottom view of the waste bin assembly of the 4000.

The prior art waste bin assembly for the HP4000 cartridge 4 is illustrated in FIGS. 3A, 3B and 3C. The waste bin assembly has an upper horizontal planar surface 7, an upper vertical planar surface 8, a lower horizontal planar surface 9, an upper left horizontal edge 10, an upper right horizontal edge 11, a lower left horizontal edge 12, a lower right horizontal edge 13, a left front vertical edge 14, a right front vertical edge 15, a left horizontal wing 16 and a right horizontal wing 17.

In the HP4000 to HP4100 conversion method, the portion being removed will be located in the forward section of the waste bin assembly. In the preferred embodiment, the recess created by removing the portion for the 4100 conversion will be bound by an upper horizontal left front corner located about 3½" from the upper left horizontal edge at the vertical planar surface, an upper horizontal right front corner located about 3½" from the upper right horizontal edge at the vertical planar surface, an upper left rear corner located about 3½" from the upper left horizontal edge and about ¾" from the vertical planar surface, an upper right rear corner located about 3½" from the upper right horizontal edge and about ¾" from the vertical planar surface, a lower left horizontal corner located about 3½" from the lower left horizontal edge, about 1" from the upper horizontal left rear corner and about ½" from the vertical planar surface, and a lower right horizontal bottom corner located about 3¾" from the lower right horizontal edge, about 1" from the horizontal right rear corner, and about ½" from the vertical planar surface.

Figure 4A:
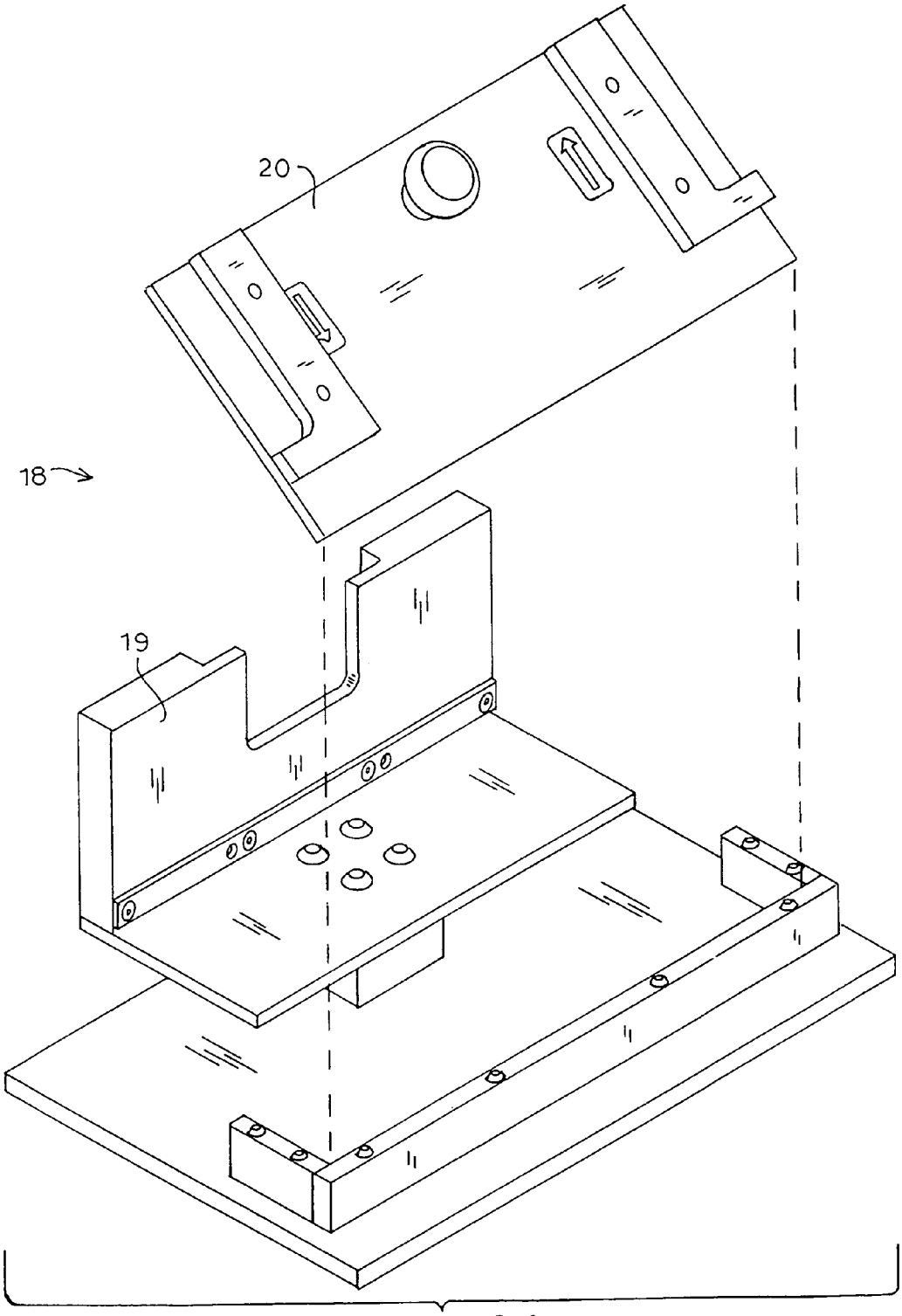
FIG. 4A is a front perspective view of a conversion fixture for the 4000 to 4100 conversion.
Figure 4B:
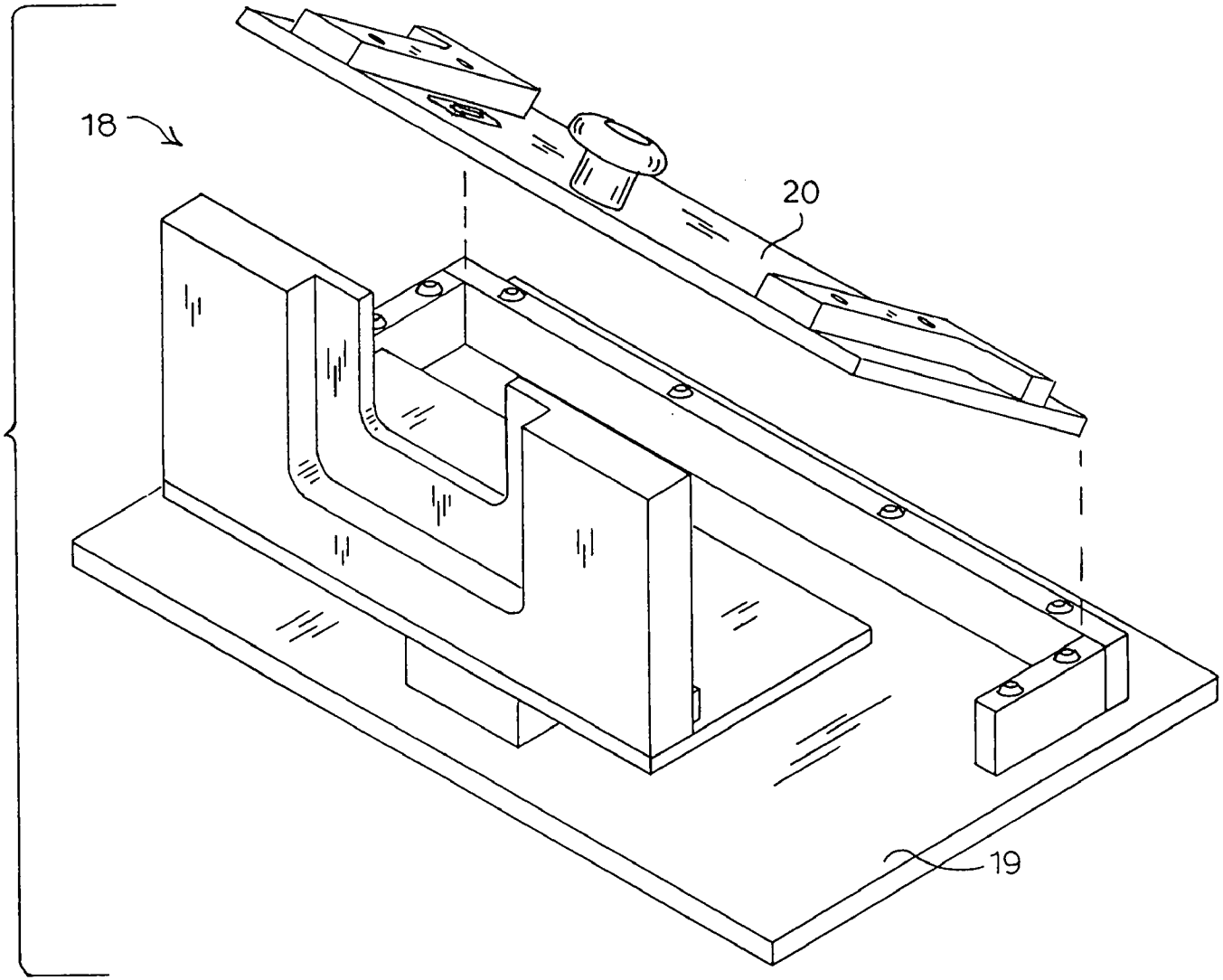
FIG. 4B is a rear perspective view of a conversion fixture for the 4000 to 4100 conversion.

In the preferred embodiment, the method for converting an HP 4000 waste bin assembly into an HP4100 waste bin assembly uses a conversion fixture which is illustrated in FIGS. 4A and 4B. The conversion fixture 18 is used to address safety and quality concerns. In addition to securing the waste bin assembly, the conversion fixture also provides a guide to assist in the removal of the portion of the waste bin assembly as well as the guide for the trimming of the left and right horizontal wings of the waste bin assembly. Other methods of securing the waste bin assembly might include the use of a clamp or a vise.

FIGS. 4A and 4B illustrate the 4100 conversion fixture 18 which contains a main housing 19 and a horizontal wing trimming guide 20. The HP4000 waste bin assembly 4 is placed in the main housing 19, snapped into place, and the horizontal wing trimming guide 20 is placed over the waste bin assembly. In the preferred embodiment, the router tool bit being used must be long enough to cut through the upper horizontal planar surface 7, the upper vertical planar surface 8 as well as the lower horizontal planar surface 9 of the waste bin assembly 4. This would require that the bit extend a minimum of 1-1¼" into the area being cut. Using the tool, the portion outlined by the conversion fixture is cut out and removed. In addition to the portion being removed, the right horizontal wing 17 and the left horizontal wing 16 will need to be trimmed back according to the outline provided by the conversion fixture.

Figure 8:
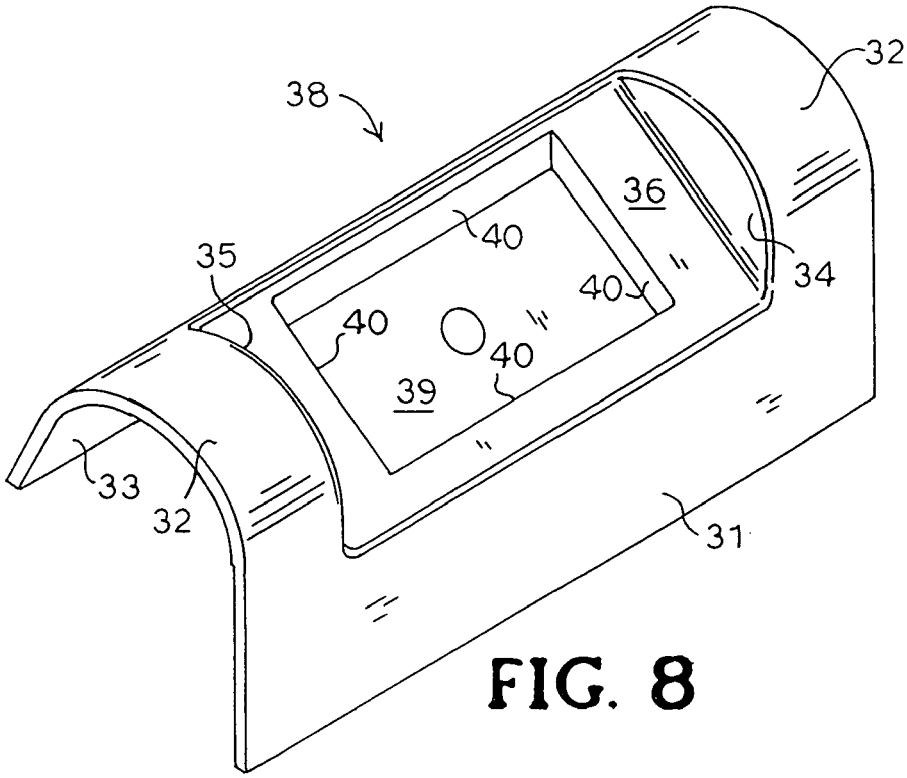
FIG. 8 shows a perspective view of a plug for the 4100 conversion.

In the preferred embodiment, the HP4100 conversion plug 38 that is used to cover the recess 6 created by this process is illustrated in FIG. 8. The plug itself consists of an upper horizontal area 33, an upper vertical area 32, a lower horizontal area 31, a right wall 34, a left wall 35, and a lower vertical area 36, a second lower vertical area 39, lower vertical walls 40. The plug may be affixed into place by various methods of attachment such as adhesive glue, tape, caulk or ultrasonic welding. In the preferred embodiment, this plug is glued into place.

Figure 5A:
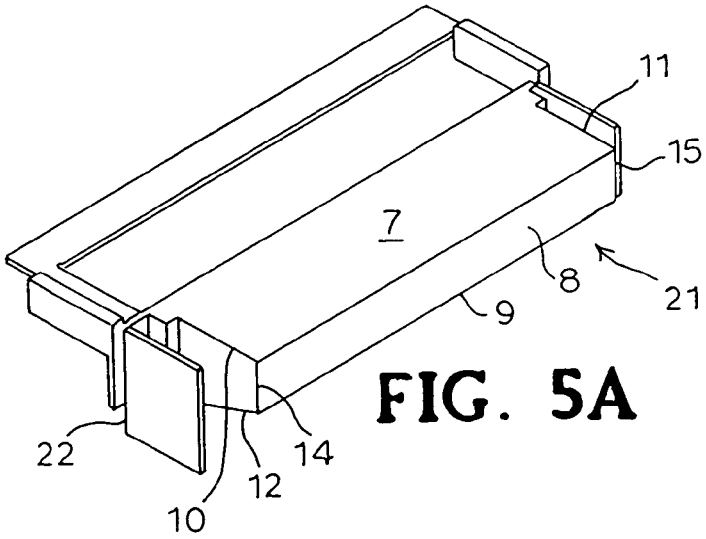
FIG. 5A shows a perspective view of the waste bin assembly of the Optra S/Se/T.
Figure 5B:
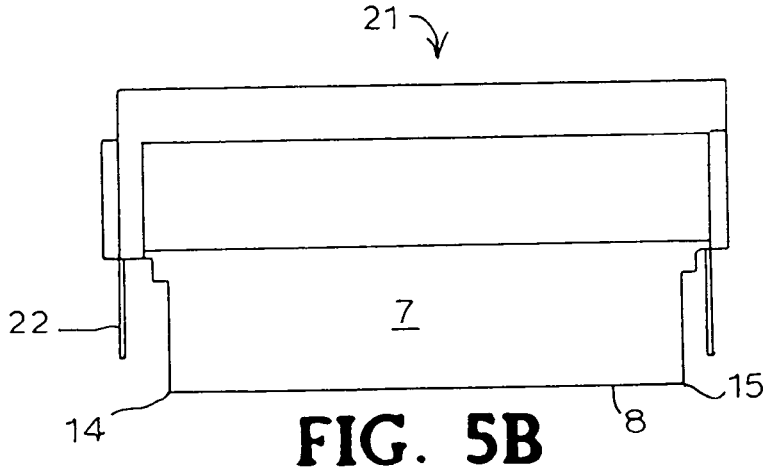
FIG. 5B shows a top view of the waste bin assembly of the Optra S/Se/T.
Figure 5C:
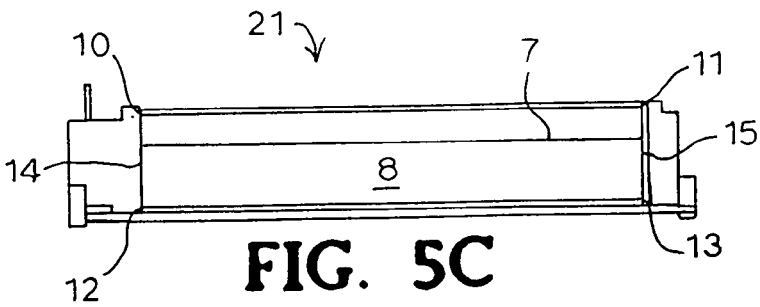
FIG. 5C shows a front view of the waste bin assembly of the Optra S/Se/T.

Another process cartridge, or toner cartridge, conversion method is converting the Lexmark Optra S/Se/T™ style of toner cartridge into a Lexmark T520/522™ style cartridge. The waste bin assembly for the Optra S/Se/T is illustrated in FIGS. 5A, 5B and 5C. The waste bin assembly has an upper horizontal planar surface 7, an upper vertical planar surface 8, a lower horizontal planar surface 9, an upper left horizontal edge 10, an upper right horizontal edge 11, a lower left horizontal edge 12, a lower right horizontal edge 13, a left front vertical edge 14, a right front vertical edge 15.

Figure 6:
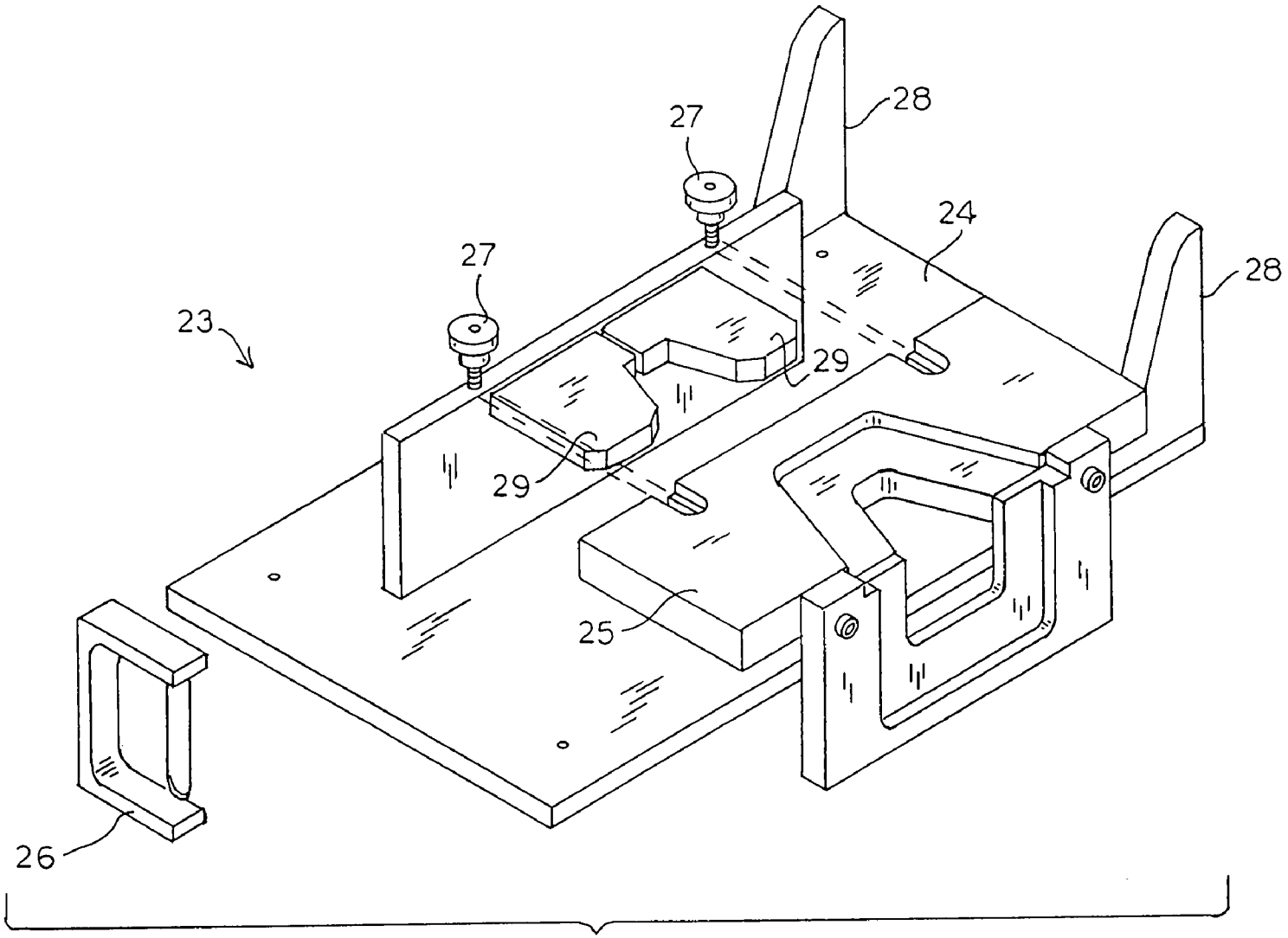
FIG. 6 is a front view of a conversion fixture for the Optra S/Se/T to T520/522 conversion.

In the preferred embodiment for an Optra S/Se/T conversion, the waste bin assembly may be placed into the T520/522 conversion fixture 23. FIG. 6 shows a T520/522 conversion fixture. This fixture has three pieces, the main housing 24, the securing attachment 25 and the integrated circuit cutout piece 26. The waste bin assembly is inserted into the main housing such that the main body is resting on the housing guide pieces 29. After the waste bin assembly is firmly positioned on the main housing 24, the securing attachment 25 is connected to the main housing 24 and secured with the securing screws 27. Once the waste bin assembly is firmly secured, a portion of the waste bin assembly can now be removed according to the outline of the conversion fixture. This will require an initial cut with the tool on the upper horizontal planar surface 7. The next cut will be on the upper vertical planar surface 8 according to the outline of the conversion fixture.

In the preferred embodiment, the recess on the waste bin assembly for the T520/522 conversion will have an upper left horizontal front corner located about 3¾" from the upper left horizontal edge and at the front vertical edge, an upper right horizontal front corner located about 3¾" from the upper right horizontal edge and at the front vertical edge, an upper left horizontal rear corner located about 4½" from the upper left horizontal edge and about 1½" from the front vertical edge, an upper right horizontal rear corner located about 4½" from the upper right horizontal edge and about 1½" from the front vertical edge, a lower left horizontal bottom corner located about 3¾" from the front left vertical edge and about 1" from the upper horizontal left front corner, and a lower right horizontal bottom corner located about 3¾" from the front right vertical edge and about 1" from the upper horizontal right front corner.

In the preferred embodiment, after the portion of the waste bin assembly has been removed, the integrated circuit cutout piece 26 is attached to the left side of the waste bin assembly 21. The waste bin assembly 21 is then turned on its side such that the conversion fixture is resting on its side feet 28. Then the integrated circuit cutout is made using either the same tool previously utilized to remove the portion of the waste bin assembly or something similar. An integrated circuit board can then be inserted into this aperture and affixed into place. Other methods of creating a void in the waste bin assembly might be to use shears, scissors, a drill or other tools intended to remove this material. Once the material has been removed, an integrated circuit board is affixed in this area.

Figure 7A:
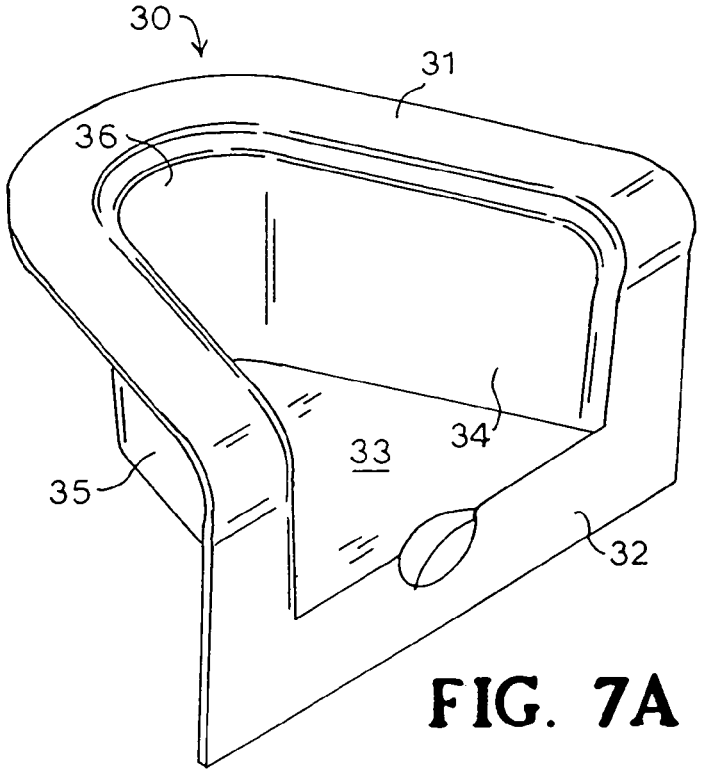
FIG. 7A shows a perspective plug for the T520/522 conversion (straight vertical planar surface).
Figure 7B:
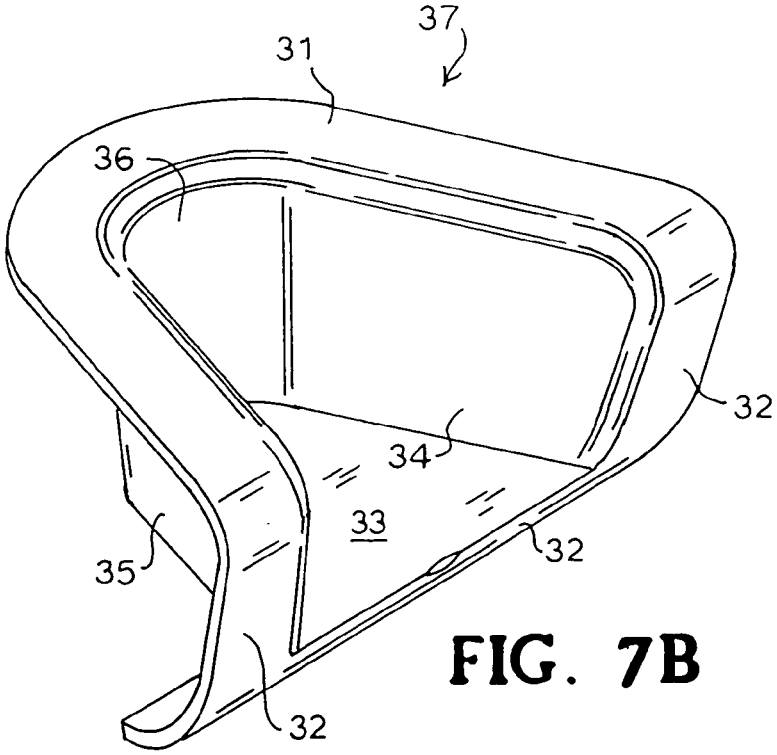
FIG. 7B shows a perspective view of a plug for the T520/522 conversion (curved vertical planar surface).

In the preferred embodiment, the T520/522 conversion plug 30 that is used to cover the recess created by this conversion process is illustrated in FIGS. 7A and 7B. FIG. 7A shows a plug used for a straight front vertical planar surface on the waste bin assembly, while FIG. 7B shows a plug used where the upper vertical planar surface of the waste bin assembly is slightly rounded. Both plugs 30 in the preferred embodiment consists of an upper horizontal area 31, an upper vertical area 32, a lower horizontal area 33, a right wall 34, a left wall 35, and a lower vertical area 36.

Figure 10A:
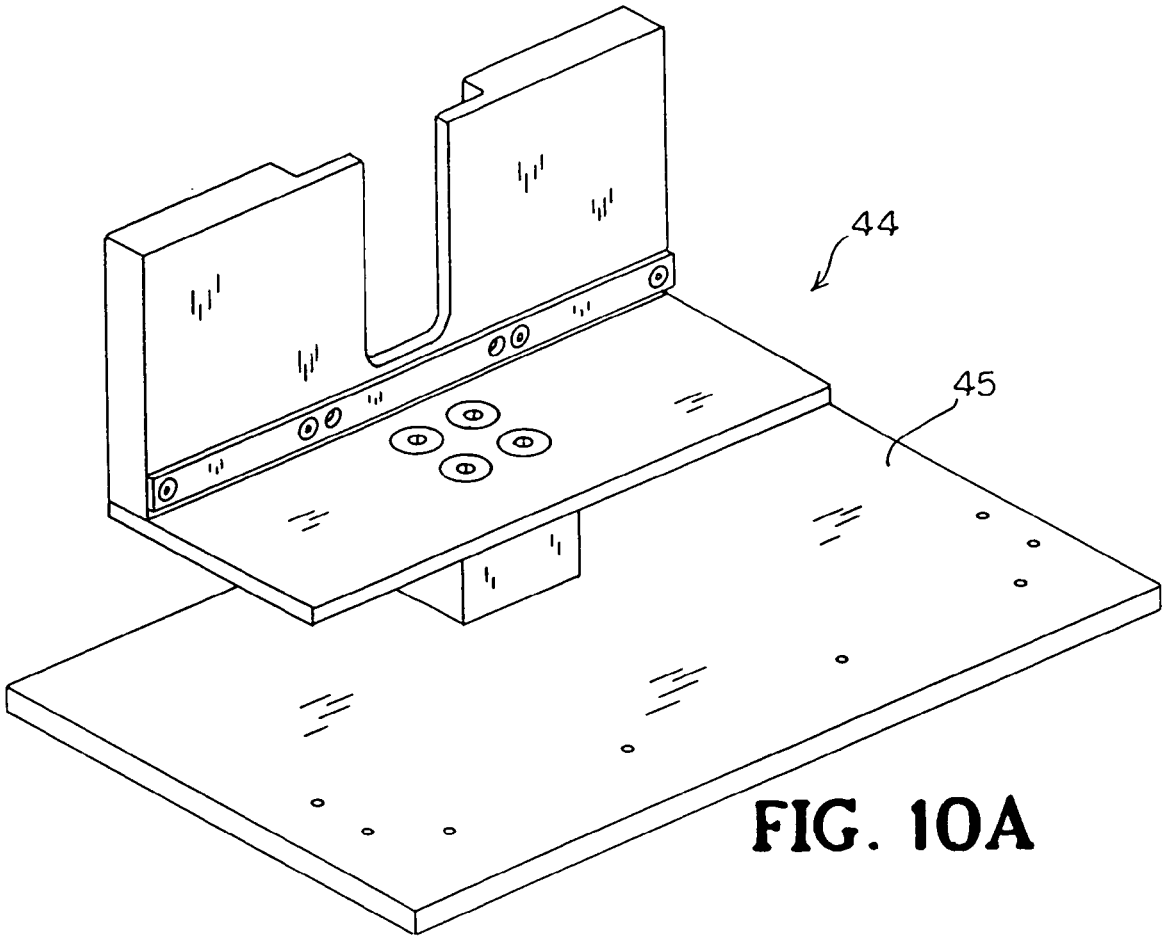
FIG. 10A is a front perspective view of a conversion fixture for the 4000 to FX6 conversion.
Figure 10B:
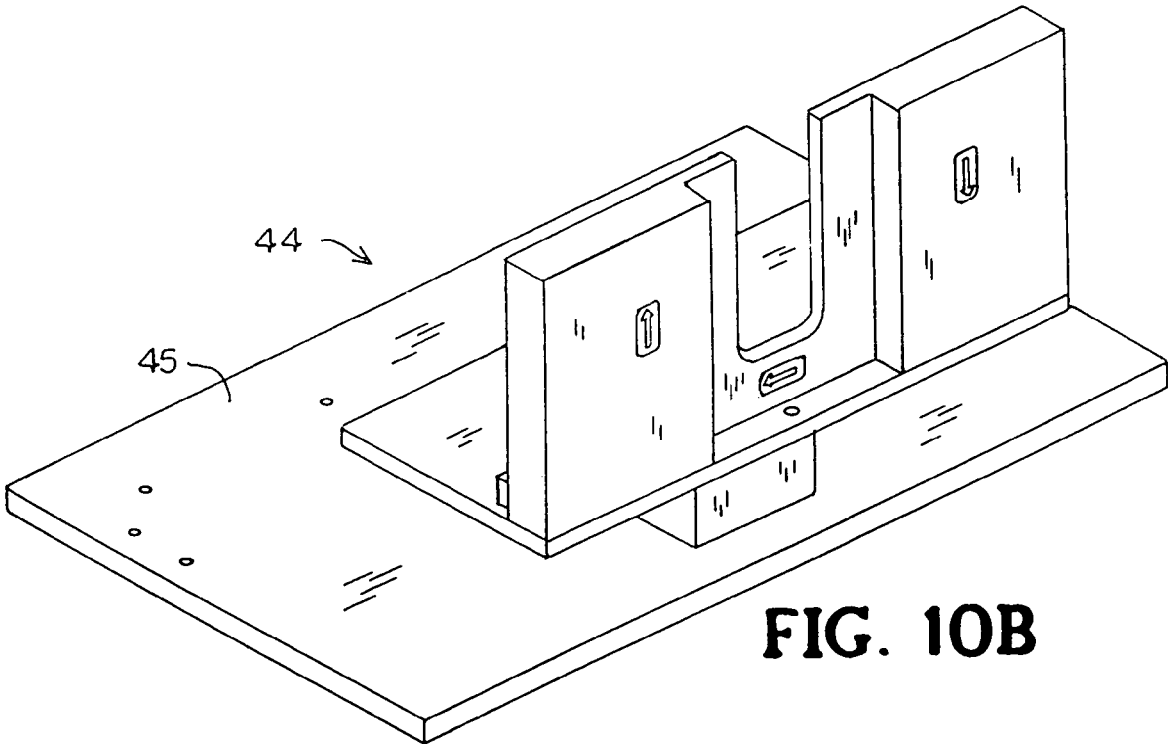
FIG. 10B is a rear perspective view of a conversion fixture for the 4000 to FX6 conversion.

For converting the HP4000™ cartridge to a Cannon FX6™ compatible process or toner cartridge, the process is roughly the same as that previously described for the 4100 conversion. FIGS. 10A and 10B illustrate the conversion fixture 44 in the preferred embodiment for this method of modification. The fixture contains only a main housing 45. The HP4000 waste bin assembly is placed in the main housing 45 and simply snaps into place. The router tool bit being used must be long enough to cut through the upper horizontal planar surface 7, the upper vertical planar surface 8 as well as the lower horizontal planar surface 9. Using the tool, the portion outlined by the conversion fixture is removed.

In the preferred embodiment, the recess on the waste bin assembly for the FX6 conversion will have an upper horizontal left front corner located about 4" from the upper left horizontal edge at the front vertical edge, an upper horizontal right front corner located about 4" from the upper right horizontal edge at the front vertical edge, an upper left rear corner located about 4" from the upper left horizontal edge and about 2" from the vertical planar surface, an upper right rear corner located about 4" from the upper right horizontal edge and about 2" from the vertical planar surface, a lower left horizontal corner located about 4" from the lower left horizontal edge and about 1½" from the vertical planar surface, and a lower right horizontal bottom corner located about 4" from the lower right horizontal edge and about 1½" from the vertical planar surface.

Figure 9:
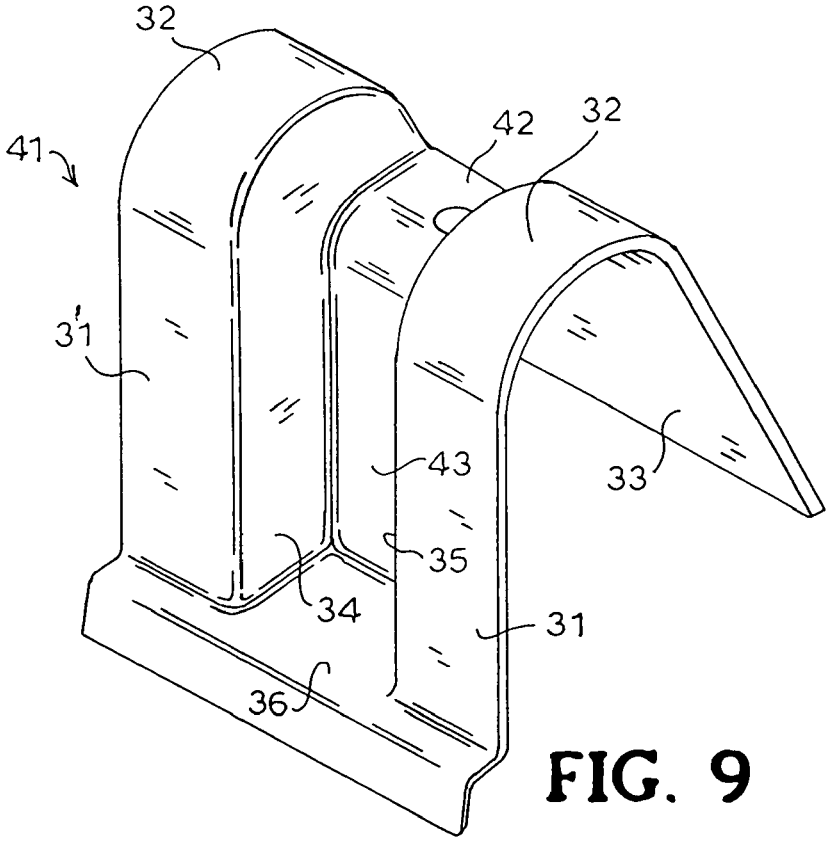
FIG. 9 shows a perspective view of a plug for the FX6 conversion.

In the preferred embodiment, the FX6 conversion plug 41 that is used to cover the recess created by this process is illustrated in FIG. 9. The plug itself consists of an upper horizontal area 31, an upper vertical area 32, a lower horizontal area 33, a right wall 34, a left wall 35, and a lower vertical area 36, intermediate horizontal area 43 and an intermediate vertical area 42. The plug may be affixed into place by various methods of attachment such as adhesive glue, caulk or ultrasonic welding.

The conception and the specific embodiments disclosed above may be readily utilized as a basis for modifying or designing other structures for carrying out the purposes of the present invention. Such equivalent constructions do not depart from the spirit and scope of the invention as set forth in the following claims.

What is claimed is:

1. A method for modifying a process cartridge comprising:

providing the process cartridge comprising a waste bin assembly; and altering at least the waste bin assembly of the process cartridge to form an altered process cartridge, wherein the waste bin assembly comprises a waste bin and the step of altering comprises removing a portion of the waste bin of the process cartridge to form a recess in the altered process cartridge, wherein altering further comprises covering the recess with a plug, wherein the plug forms an indentation in the waste bin.

2. A method for modifying a process cartridge comprising:

providing the process cartridge comprising a waste bin assembly;

altering at least the waste bin assembly of the process cartridge to form an altered process cartridge; and attaching a circuit board to the altered process cartridge, wherein the process cartridge will operate in a first type of printing device and will not operate in a second type of printing device, and wherein the altered process cartridge will operate in the second type of printing device.

* * * * *